United States Patent [19]

Poldervaart et al.

[11] Patent Number: 4,907,995

[45] Date of Patent: Mar. 13, 1990

[54] MOORING DEVICE

[75] Inventors: Leendert Poldervaart, La Turbie; Patrick Ducousso, Falicon, both of France

[73] Assignee: Single Buoy Moorings Inc., Marly, Switzerland

[21] Appl. No.: 318,144

[22] Filed: Mar. 2, 1989

[30] Foreign Application Priority Data

Apr. 8, 1988 [NL] Netherlands ..... 8800915

[51] Int. Cl.[4] ..... B63B 22/02

[52] U.S. Cl. ..... 441/3; 114/230

[58] Field of Search ..... 114/230, 293; 441/3–4

[56] References Cited

U.S. PATENT DOCUMENTS 4,637,336 1/1987 Engelskirchen ..... 114/293

FOREIGN PATENT DOCUMENTS 2015455 9/1979 United Kingdom .

*Primary Examiner*—Joseph F. Peters, Jr.
*Assistant Examiner*—Jesûs D. Sotelo
*Attorney, Agent, or Firm*—Young & Thompson

[57] ABSTRACT

Mooring device comprising a tower fixed to the water bottom, a ship and two rigid connecting arms, which are pivotably connected about horizontal axes to a turntable on the tower and which each are connected at or adjacent their ends by weight loaded connecting elements to the ship. These arms extend in opposite directions so that the two springs, each comprising an arm, a weight and a connecting elements counteract each other to obtain a desired force/travel curve, allowing a larger shift of the ship.

5 Claims, 2 Drawing Sheets

MOORING DEVICE

The invention relates to a mooring device, comprising a ship or similar floating device, a structure placed on and fixed to the water bottom and provided with an element which rotates about a vertical axis, a rigid arm which is fixed to the element so that it can rotate about a horizontal axis, and which faces away from the element and is loaded by a weight, and a tension-proof connecting element which is hingedly or flexibly connected at one end to the arm and at the other end to the ship.

Such a mooring device is known, for example from FIG. 6 of GB-A-2,015,455. In this known mooring device the weight which loads the rigid arm ensures that there is a tension present in the tension-proof connecting element. The initial position of this tension-proof connecting element is essentially vertical. If the ship moves away from the vertical through the structure fixed to the bottom, the tension in the tension-proof connecting element ensures that, depending on the angle of the deviation, where the connecting element is connected to the ship a restoring force is produced to try to return the ship to the initial position. Due to the fact that the rigid arm can swing about a vertical axis, the ship can adjust in the direction of waves, current and wind.

This known mooring device has the character of a spring which very quickly becomes rigid with increasing deviation in the position of the ship. This characteristic is undesirable when adjustment to greater wave movements becomes necessary. With the existing mooring device, only the force of the spring can be changed by changing the weight, but the characteristic cannot be changed. For, with increasing displacement the connection between ship and structure fixed on the water bottom, and comprising the tension-proof connecting element, will be pulled taut.

The object of the invention is to produce a mooring device with connecting element, essentially remaining under water, between ship and structure fixed on the water bottom, in which it is possible to adjust the spring characteristic as desired.

This object is achieved according to the invention in the first place in that the element has connected to it a second rigid arm which is rotatable about a horizontal hinge and is directed in the opposite direction to that of the first arm, and which is also loaded by a weight and hingedly or flexibly connected to the ship by a connecting element that resists tension.

There are thus two systems now, each comprising a rigid arm, a weight and a connecting element that resists tension, trying to hold the ship in place. Since, however, the rigid arms run in opposite directions, when the ship shifts the action of the weight in one of the two connecting systems will always decrease when the action of the weight of the other system increases.

By choosing the length of the arms, the masses of the weights and the relative angular positions, it is now possible to design any desired spring characteristic.

The connecting points of the tension-proof connecting elements are preferably spaced apart in the lengthwise direction of the ship. These connecting points are generally at and near the bow of the ship, but it is also conceivable for one to be near the front end and the other to be further towards the rear end. It is also conceivable to place the connecting points entirely under water. The length of the connecting elements that resist tension can also be made adjustable by coupling to internally or externally placed winches, so that the initial angular position of each system, and thus the total spring characteristic, can be adjusted to the circumstances.

The structure preferably consists of an underwater tower with the top under the bottom of the ship and with the two arms and the tension-proof connecting elements in the initial position placed in such a way relative to each other that they form an acute angle with each other.

The rigid connecting elements are preferably designed as triangular frames with the bases facing each other.

The invention will now be explained in greater detail with reference to the drawing.

FIG. 1 shows schematically in side view the principle of the mooring device according to the invention, in the initial position.

FIG. 2 corresponds to FIG. 1 and shows the position which is assumed after a shift.

Figure 1:
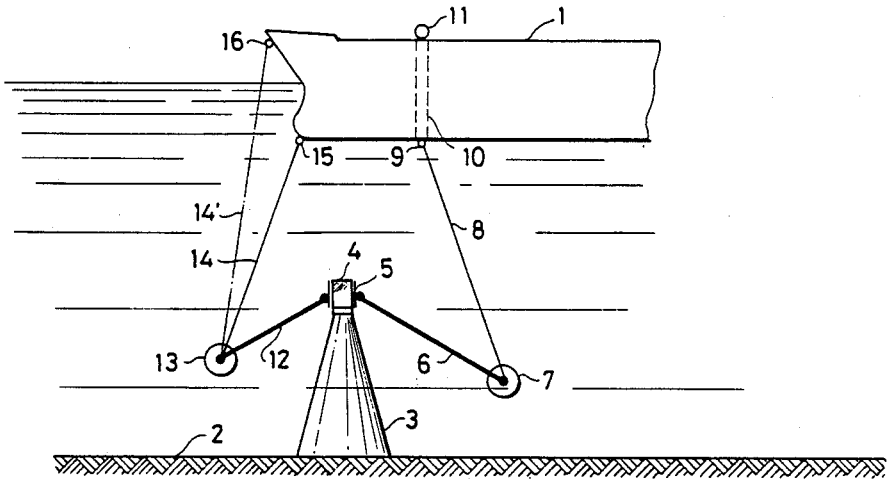
Figure 2:
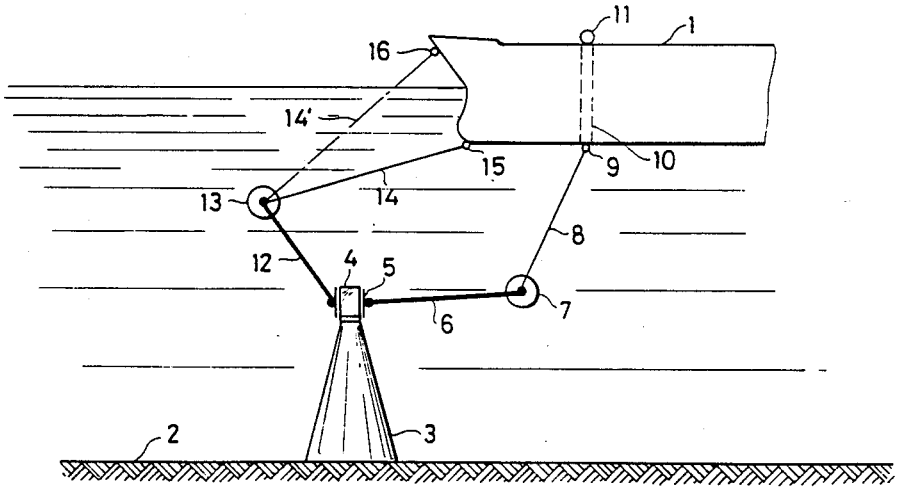

FIGS. 1 and 2 show a ship 1 and a tower 3, which is placed on the water bottom 2, and which has at the top 4 a slewing ring 5 forming the element rotating about the vertical axis. This slewing ring has a rigid arm 6 with a weight 7, and the arm 6 can be formed by a triangle. The end of the arm is connected to the ship 1 at the weight 7 by means of a cable 8, for example in the connecting point 9.

It is, however, possible for the cable to run via a duct 10 to the deck of the ship 1 and connect there to a winch 11.

The slewing ring 5 also has a second rigid, preferably triangular arm 12, carrying a weight 13 which is connected to the ship at 15 by means of a cable 14. This point can also be adjustable. It is also possible for the cable 14 to run to the bow, as shown by the broken line 14', and to engage there with a winch 16. The inside ends of the triangular frames 6, 12 are fixed to the slewing ring 5 so that they rotate about horizontal axes.

Figure 3:
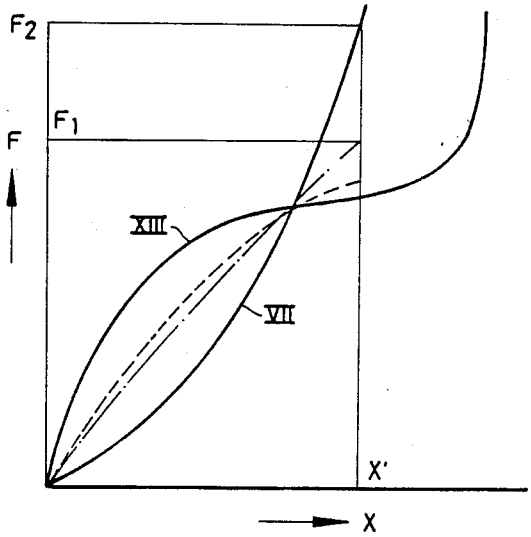
FIG. 3 is a graph showing the correlation between shift and restoring force.
Figure 4:
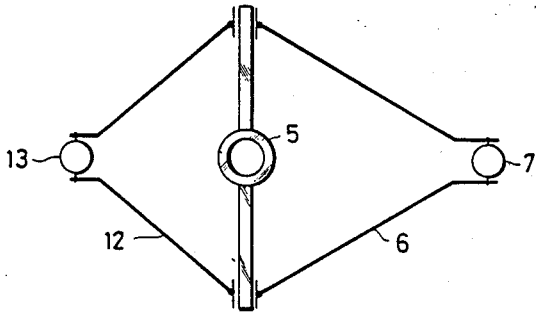
FIG. 4 is a schematic top view of the rigid arms.

FIG. 2 shows a shift, and FIG. 3 indicates by the curve VII the force/travel curve and thus the characteristic of the spring which is formed by the weight 7, arm 6 and cable 8. This spring thus becomes more rigid with increasing shift.

However, FIG. 2 also shows that as the weight 13 is lifted this weight is carried more and more by the structure 3, while the moment exerted by the cable 14 becomes increasingly beneficial. The force/travel graph of the spring, which is formed by the weight 13, the arm 12 and the cable 14, is indicated in FIG. 3 by XIII. This graph shows a clear levelling-off after an initial rise. The two curves can be determined as desired and the resultant, and thus the total characteristic, of the spring system of the mooring device according to the invention is the resultant of the two curves.

This has made it possible to design a mooring system for an area or circumstances for which there had previously been no suitable solution, because the forces occurring were no longer admissible for the existing designs of ship and mooring device.

The curves in FIG. 3 show this. If only the system comprising the arm 6, the weight 7 and the cable 8 is present, then a force equal to $F_2$ occurs in the system when there is a shift x'.

If, however, according to the invention the two systems are used, then with the same shift x' the force in the system is smaller, i.e. $F_1$.

We claim:

1. Mooring device, comprising a ship or similar floating device, a structure placed on and fixed to the water bottom and provided with an element which rotates about a vertical axis, a rigid arm which is fixed to the element so that it can rotate about a horizontal axis, and which extends in a direction away from the element and is loaded by a weight, and a connecting element which resists tension and which is connected at one end to the arm and at the other end to the ship, characterized in that the first-mentioned element has connected to it a second rigid arm which is rotatable about a horizontal axis and is directed in the opposite direction to that of the first arm, and which is also loaded by a weight and connected to the ship by a connecting element which resists tension.

2. Mooring device according to claim 1, characterized in that the connecting points of the connecting elements are spaced apart in the lengthwise direction of the ship.

3. Mooring device according to claim 2, characterized in that the connecting points lie under water.

4. Mooring device according to claim 1, characterized in that the two arms are essentially triangular arms, with their bases facing each other.

5. Device according to claim 1, characterized in that the structure is an underwater tower with the top under the bottom of the ship, and the two arms in the initial position form an acute angle with the connecting elements.

* * * * *